US012281491B2

(12) United States Patent
Niewiarowski

(10) Patent No.: US 12,281,491 B2
(45) Date of Patent: Apr. 22, 2025

(54) ZIG ZAG PATTERN SWIMMING POOL CLEANER

(71) Applicant: Kreepy Krauly Australia Pty Ltd, Western Australia (AU)

(72) Inventor: Wieslaw Niewiarowski, Western Australia (AU)

(73) Assignee: Kreepy Krauly Australia Pty Ltd, Western Australia (AU)

( * ) Notice: Subject to any disclaimer, the term of this patent is extended or adjusted under 35 U.S.C. 154(b) by 0 days.

(21) Appl. No.: 17/754,883

(22) PCT Filed: Oct. 16, 2020

(86) PCT No.: PCT/AU2020/051119
§ 371 (c)(1),
(2) Date: Apr. 14, 2022

(87) PCT Pub. No.: WO2021/072504
PCT Pub. Date: Apr. 22, 2021

(65) Prior Publication Data

US 2024/0093520 A1 Mar. 21, 2024

(30) Foreign Application Priority Data

Oct. 18, 2019 (AU) ..... 2019903940

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654; A47L 11/4063; A47L 11/4066
(Continued)

(56) References Cited

U.S. PATENT DOCUMENTS 6,782,578 B1 8/2004 Rief et al.
2002/0117133 A1* 8/2002 Ma ..... F01L 1/022 123/90.15
(Continued)

FOREIGN PATENT DOCUMENTS

EP 2860329 A1 4/2015
EP 3034718 A1 6/2016

OTHER PUBLICATIONS

International Search Report issued for International Patent Application No. PCT/AU2020/051119, dated Jan. 18, 2021 in 6 pages.
(Continued)

*Primary Examiner* — Mahdi H Nejad
*Assistant Examiner* — Aaron R McConnell
(74) *Attorney, Agent, or Firm* — Knobbe, Martens, Olson & Bear, LLP

(57) ABSTRACT

A suction pool cleaner for cleaning of a pool surface, the pool cleaner comprising a housing having a debris inlet for suction-drawn flow of water and debris, a first leg assembly and a second leg assembly, each leg assembly being pivotable with respect to the housing, each leg assembly having a rotatable loop track for moving the pool cleaner over the pool surface, the tracks being selectively rotatable in a first direction and an opposite second direction, wherein when the tracks are rotated in opposite directions to one another, the leg assemblies pivot with respect to the housing in opposite directions, thereby lifting the debris inlet away from the pool surface such that suction force between the debris inlet and the pool surface is reduced along with the footprint provided by each track such that less power is required to turn the pool cleaner.

19 Claims, 12 Drawing Sheets

(58) Field of Classification Search
USPC ..... 15/1.7
See application file for complete search history.

(56) References Cited

U.S. PATENT DOCUMENTS

| | | | | |
|---|---|---|---|---|
| 2008/0087299 | A1 | 4/2008 | Erlich et al. | |
| 2008/0307589 | A1 | 12/2008 | Schneider et al. | |
| 2014/0251038 | A1 | 9/2014 | Kumar et al. | |
| 2015/0101135 | A1* | 4/2015 | Witelson | E04H 4/1654 15/1.7 |
| 2016/0153210 | A1* | 6/2016 | Sebor | E04H 4/1654 15/1.7 |

OTHER PUBLICATIONS

International Preliminary Report on Patentability issued for International Patent Application No. PCT/AU2020/051119, dated Oct. 18, 2021 in 5 pages.
Extended European Search Report dated Sep. 27, 2023 for EP Application No. 208775537.9 in six pages.

* cited by examiner

ZIG ZAG PATTERN SWIMMING POOL CLEANER

CROSS-REFERENCE TO RELATED APPLICATIONS

This application is the U.S. National Phase under 35. U.S.C. § 371 of International Application PCT/AU2020/051119, Oct. 16, 2020, which claims priority to Australian Patent Application No. 2019903940, filed Oct. 18, 2019. The disclosures of the above-described applications are hereby incorporated by reference in their entirety.

FIELD OF THE INVENTION

The present invention relates to swimming pool cleaners. More specifically the present invention relates to a mechanical suction pool cleaner.

BACKGROUND TO THE INVENTION

Automatic pool cleaners endeavour to maintain cleanliness of a swimming pool with minimal if any, human interaction. Pool cleaners function like a vacuum cleaner to collect sand, leaves, debris and insects from the swimming pool. However, rather than being pushed along the surface of the pool floor by a person, an automatic pool cleaner is designed to move around the pool autonomously. In this regard, automatic pool cleaners are self-propelled devices which during operation attach to the surface (floor and walls) of the swimming pool by negative pressure (vacuum).

In general, there are two types of pool cleaners, namely electric cleaners and suction cleaners. Electric cleaners are driven by an electric motor connected by a flexible cable from an external power supply or the internal batteries. In contrast, suction pool cleaners are powered by an external vacuum and filtering system. More specifically, suction cleaners are driven by energy from flowing water through the cleaner which is connected to the pool's external filtration system by a flexible hose. Some suction cleaners propel themselves by interrupting water flow. The inertia force of the interrupted mass of water in the cleaner drives the cleaner forwards. As shown in FIG. 1, by pushing forward and bending the hose, the cleaner changes direction. A problem with this type of cleaner is that the cleaning pattern depends on the flexibility of the hose and the shape of the pool. Further, the pool cleaner tends to run in circles around the pool and get stuck in the corners. They also take a very long time to clean all surfaces of the pool.

Another type of suction pool cleaner is driven by the energy of water flowing through a turbine. The rotating turbine is connected by cams or gears to wheels, legs or tracks, which propel the cleaner against the pool surface. Navigation across the surface is achieved by two methods. The first method involves slowly spinning the pool cleaner against the hose in a clockwise and anticlockwise direction a few times to make the cleaner travel in a circular pattern across the pool, as shown in FIG. 2. The second method involves reversing drive on one side of the cleaner for a set time to force the cleaner to spin at a set angle in one direction against the surface of the pool floor and then travel in a straight line after that, as shown in FIG. 3. However, this type of cleaning pattern is not very efficient as the cleaner repeats the same track many times leaving patches of the pool surface uncleaned. In addition, it can take 8 or more hours to achieve a reasonable cleaning outcome.

The most efficient way to clean a pool surface is by travelling in a Zigzag pattern across the pool surface. Electric cleaners achieve this by changing the direction and speed of two electric motors on each side of the cleaner. An electronic controller program precisely switches the travel direction of each side of the cleaner at different times, causing the cleaner to rotate typically 15° clockwise. After a set time the controller reverses the action causing the cleaner to rotate anticlockwise. After each rotation, the cleaner travels in strait lines with the net outcome being a zigzag cleaning pattern. By travelling in a zigzag pattern, a swimming pool can be cleaned in one hour or less with perfect surface coverage, saving wear and energy of the filtration system. Unlike electric cleaners, suction pool cleaners generally do not have electronic timers and the like and instead rely on mechanical means for controlling the cleaning pattern.

Furthermore, it takes considerable power to steer a suction pool cleaner, particularly tracked suction pool cleaners which have a pair of ground engaging, continuous rubber tracks driven by one or more drive wheels. With this type arrangement, steering is controlled by altering the speed and direction of each track. As the pool cleaner turns, the leading and trailing ends of the elongated footprint/contact patch provided by the tracks, skids sideways, perpendicular to the direction the tracks roll. In FIG. 3A, the arrows indicate the direction in which the contact patch will move during a clockwise turn. The further toward the ends, the more the track will move in a direction other than the direction in which it would normally move. FIG. 3A shows the magnitude of the frictional forces that must be overcome in order to make the pool cleaner turn about its vertical axis. These are simply the horizontal component of the direction that each point of the contact patch will move as the pool cleaner rotates. The friction at any point is proportional to the distance forward of the vertical axis. The total force required is proportional to the length of the contact patch (footprint), and suction force between the cleaner and pool surface.

A problem with tracked suction pool cleaners is that the turbine of a typical suction cleaner produces only a small amount of power in the range between 5 to 10 Watts. During a turning action, the power demand increases and this can overload the turbine causing it to stall. Furthermore, the suction force between the cleaner and the pool surface also increases the power required to undertake a turning manoeuver.

It would be desirable to provide a suction pool cleaner of the above described general type which has one or more improved features.

Any discussion of documents, devices, acts or knowledge in this specification is included to explain the context of the invention. It should not be taken as an admission that any of the material formed part of the prior art base or the common general knowledge in the relevant art on or before the priority date of the claims herein.

SUMMARY OF THE INVENTION

According to a first aspect of the invention, there is provided a suction pool cleaner for cleaning of a pool surface, the pool cleaner comprising a housing having a debris inlet for suction-drawn flow of water and debris, a first leg assembly and a second leg assembly, each leg assembly being pivotable with respect to the housing, each leg assembly having a rotatable loop track for moving the pool cleaner over the pool surface, the tracks being selectively rotatable in a first direction and an opposite second direction, wherein when the tracks are rotated in opposite directions to one another, the leg assemblies pivot with respect to the housing in opposite directions, thereby lifting the debris inlet away from the pool surface such that suction force between the debris inlet and the pool surface is reduced.

According to another aspect of the invention, there is provided a suction pool cleaner for cleaning of a pool surface, the pool cleaner comprising a housing, a first leg assembly and a second leg assembly, each leg assembly being pivotable with respect to the housing, each leg assembly having a rotatable loop track for moving the pool cleaner over the pool surface, a region of each track in contact with the pool surface defining a footprint, the tracks being selectively rotatable in a first direction and an opposite second direction, wherein when the tracks are rotated in opposite directions to one another to provide a turning movement to the pool cleaner, the leg assemblies pivot with respect to the housing in opposite directions, thereby reducing the footprint provided by each track such that less power is required to turn the pool cleaner.

The suction pool cleaner may further include a rotor driven by auto flow through the pool cleaner, a first gearbox for driving the first leg assembly and a second gearbox for driving the second leg assembly, each gearbox being in use driven by rotation of the rotor.

Each gearbox preferably includes a forwards gear for driving the corresponding leg assembly in said first direction and a backwards gear for driving the corresponding leg assembly in said opposite second direction.

Each leg assembly preferably includes a track drive gear for driving the loop track in said first and second directions. Further, the leg assemblies are preferably each pivotable with respect to the housing between a first position in which the track drive gear is engaged with the forwards gear, and a second position in which the track drive gear is engaged with the backwards gear.

Each gearbox may further include a cam for moving the corresponding leg assembly between the first position and the second position. The cam is preferably driven by rotation of the rotor and includes a valley portion and a hill portion, wherein transitioning from the valley portion to the hill portion pushes the leg assembly from the first position to the second position.

Each leg assembly may further include a cam follower mounted to a respective main body of each leg assembly. The cam follower is in abutment with the corresponding gearbox cam to move the leg assembly between the first position and the second position.

The hill portion is preferably provided on about 30% to 50% of a circumference of each cam.

The cam of the first gearbox is preferably advanced in comparison with the cam of the second gearbox such that a leading edge of the hill portion of the cam of the first gearbox pivots the leg assembly to the second position before a leading edge of the hill portion of the cam of the second gearbox pivots the second leg assembly to the second position.

The cam of the first gearbox is preferably advanced by about 12° to 20° in comparison to the cam of the second gearbox.

A trailing edge of the rear portion of the cam of the first gearbox returns the first leg assembly to the first position before a trailing edge of the hill portion of the cam of the second gearbox returns the second leg assembly to the first position.

The trailing edge of the cam of the second gearbox is preferably retarded by about 17° to 25° in comparison to the trailing edge of the cam of the first gearbox.

Each leg assembly is preferably biased towards the first position by a spring mounted between the main body of the leg assembly and corresponding gearbox. Further, each leg assembly preferably pivots approximately 3.5° when moving between the first position and the second position.

When the tracks are rotated in opposite directions to one another to pivot each leg assembly with respect to the housing in opposite directions, diagonally opposite ends of the leg assemblies are preferably lifted from contact with the pool surface.

To assist in further understanding the invention, reference will now be made to the accompanying drawings, which illustrate preferred embodiments. It is to be appreciated that these embodiments are given by way of illustration only and that the invention is not to be limited by these illustrations.

DESCRIPTION OF PREFERRED EMBODIMENTS

Figure 1:
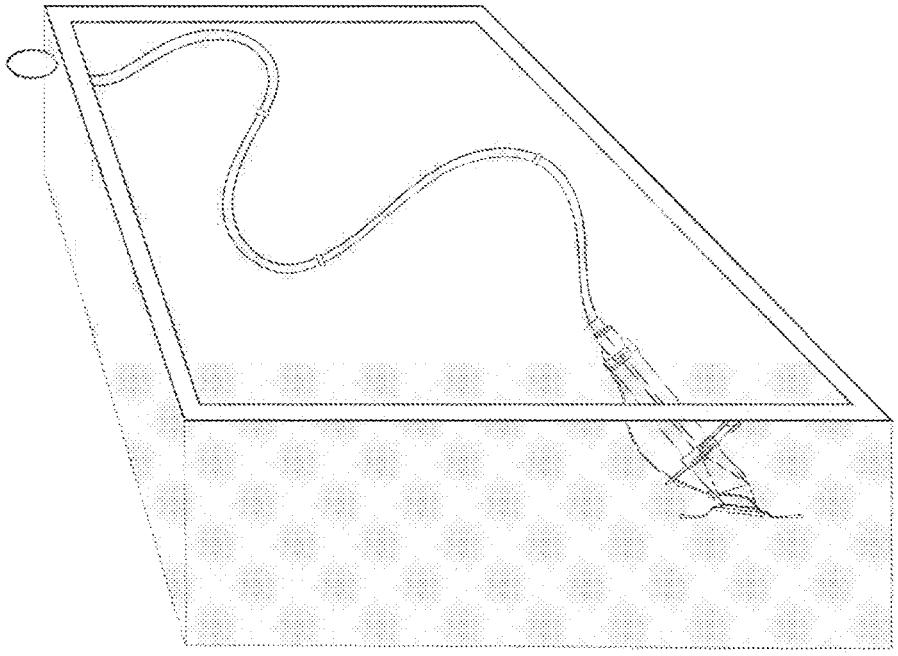
FIG. 1 is a perspective view of a suction pool cleaner in accordance with the prior art, which is able to change direction by the bending of the flexible hose connecting the cleaner to the pool's external filtration system.
Figure 2:
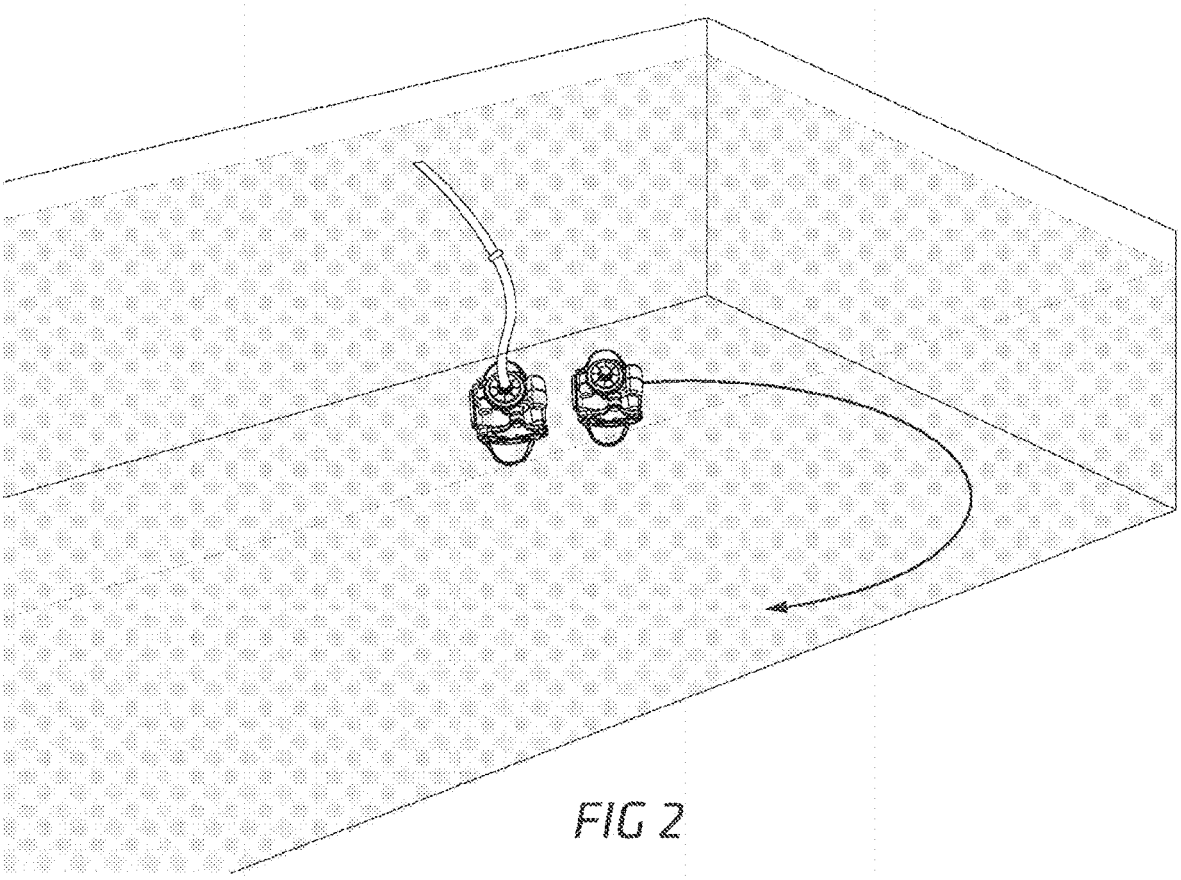
FIG. 2 is a perspective view of a suction pool cleaner in accordance with the prior art in which the pool cleaner is able to change direction by spinning the cleaner against the hose in a clockwise and anti-clockwise direction such that the cleaner travels in a circular pattern.
Figure 3:
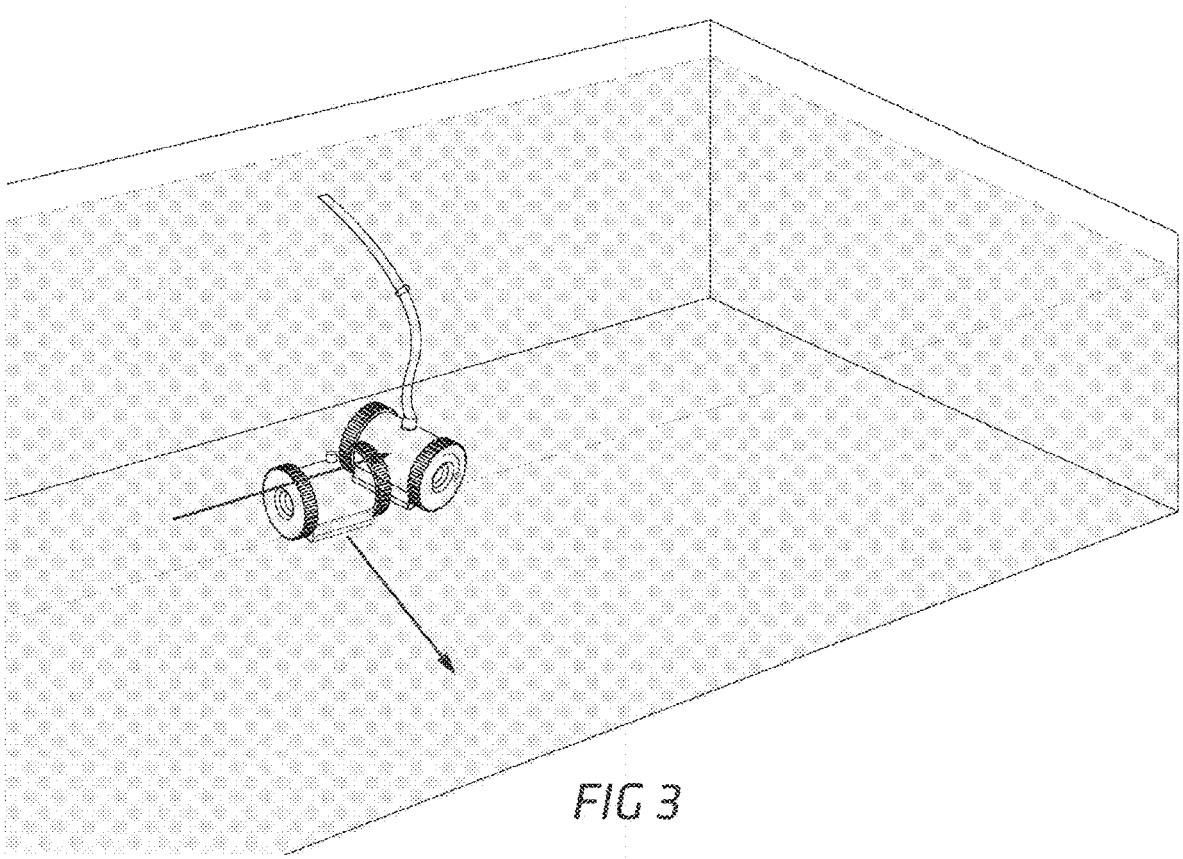
FIG. 3 is a perspective view of a suction pool cleaner in accordance with the prior art in which the direction of travel is changed by reversing drive on one side for a set period of time to force the pool cleaner to spin at a set angle in one direction.
Figure 3A:
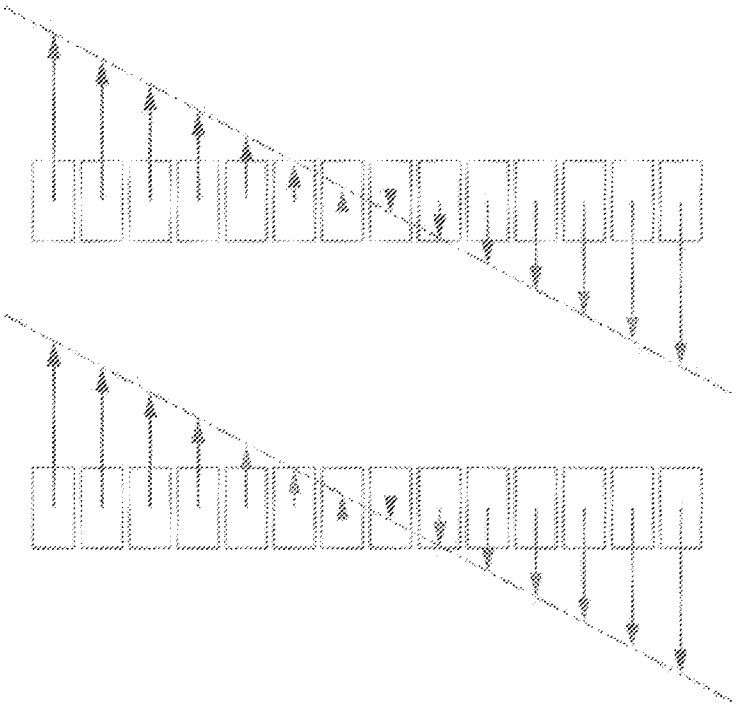
FIG. 3*a* is an illustration demonstrating the direction and magnitude of the frictional forces which must be overcome in order to make a tracked suction pool cleaner turn about its vertical axis, in accordance with the prior art.
Figure 4:
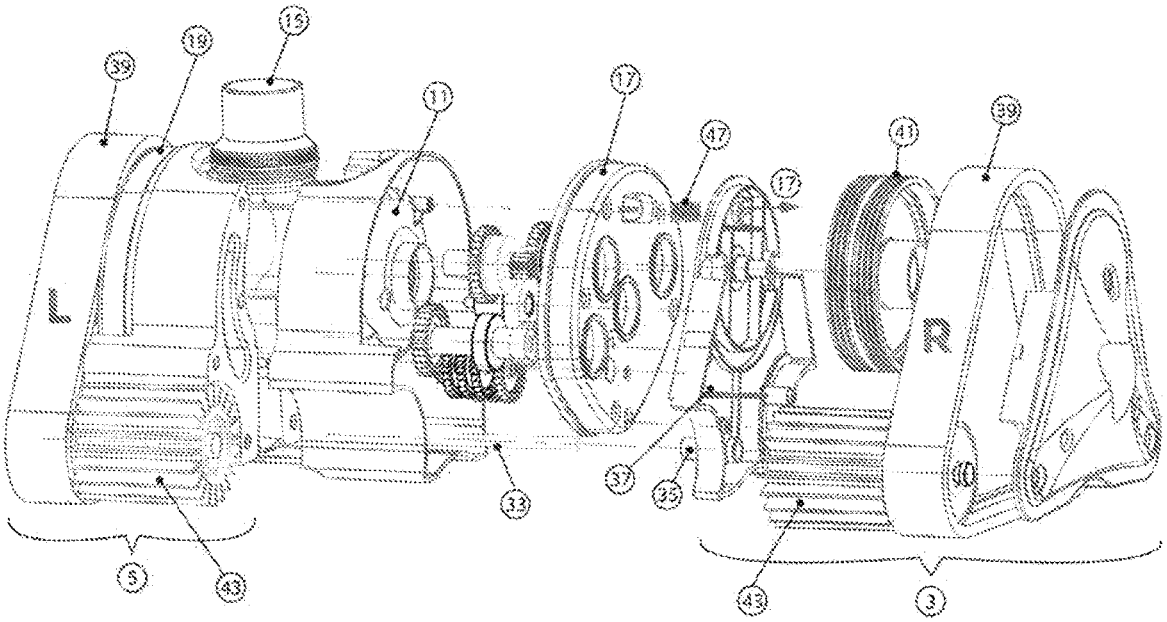
FIG. 4 is an exploded perspective view of various components of a tracked suction pool cleaner in accordance with an embodiment of the invention.
Figure 5:
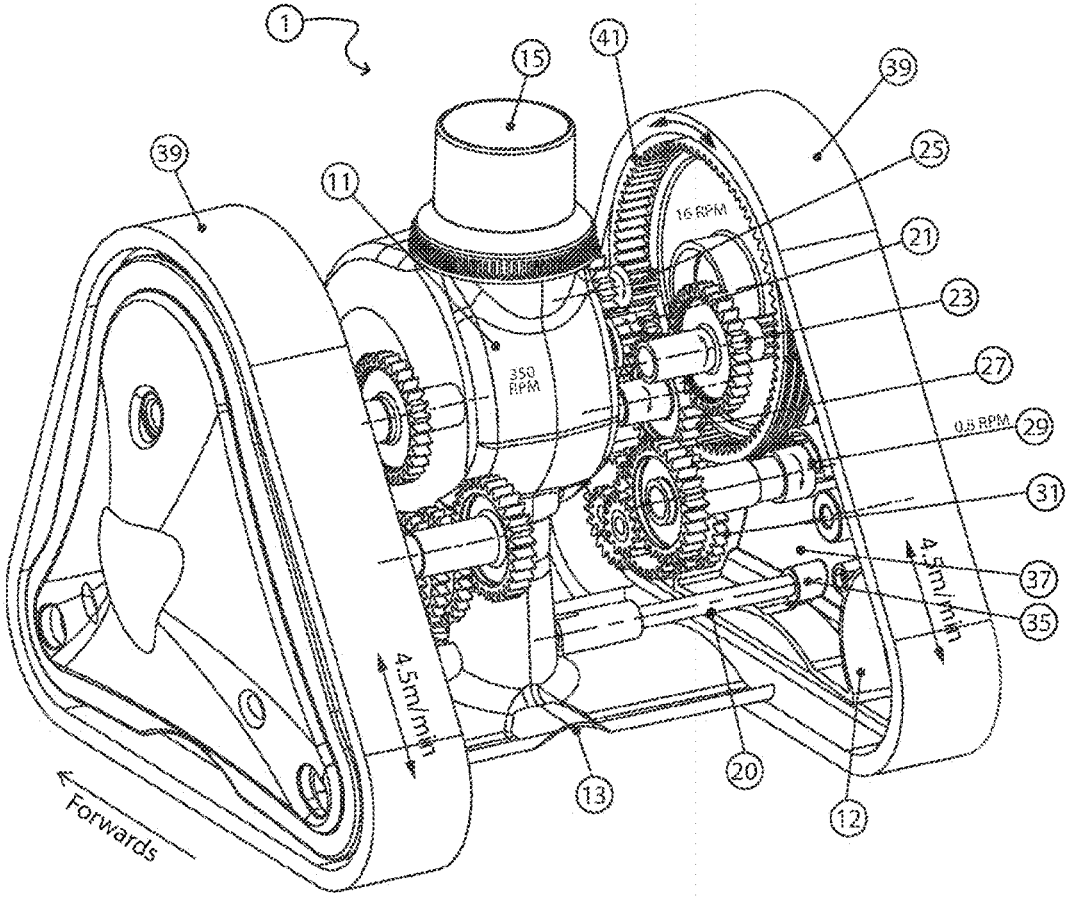
FIGS. 5 and 6 are perspective views of a tracked suction pool cleaner in accordance with an embodiment of the invention detailing various internal components.
Figure 6:
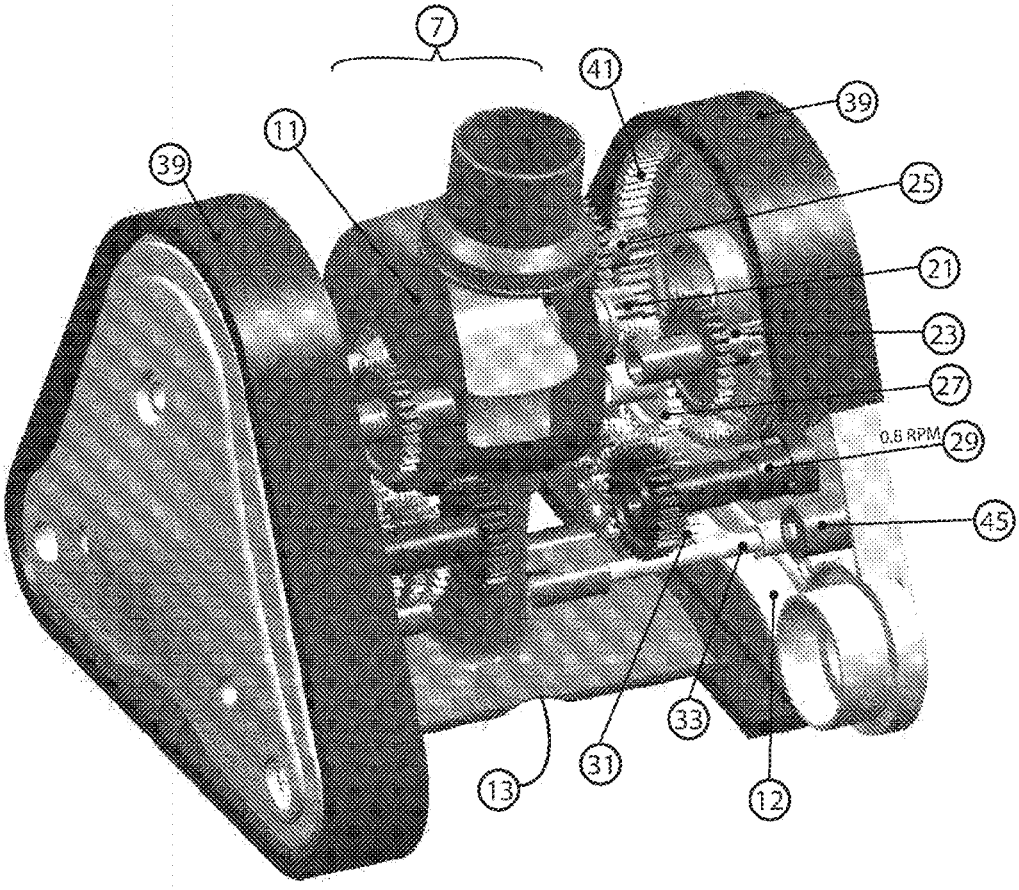

With reference to FIGS. 4, 5 and 6 of the accompanying drawings, there is shown a suction pool cleaner (1) for cleaning a swimming pool surface. The pool cleaner (1) generally includes a centrally located housing and to either side of the housing a first (right hand side) leg assembly (3) and a second (left hand side) leg assembly (5).

Figure 7:
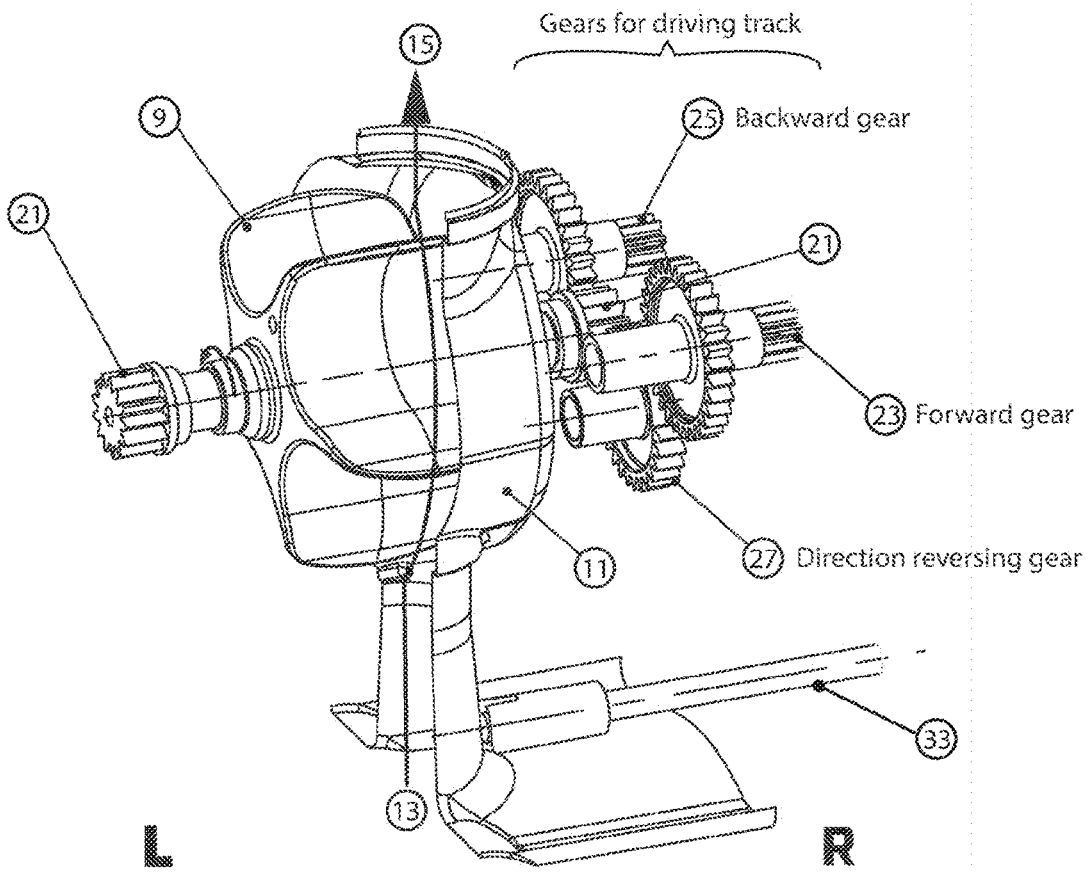
FIG. 7 is a partially cut away perspective view of the turbine assembly of the tracked suction pool illustrated in FIGS. 5 and 6 including various gears of the first gearbox.
Figure 8:
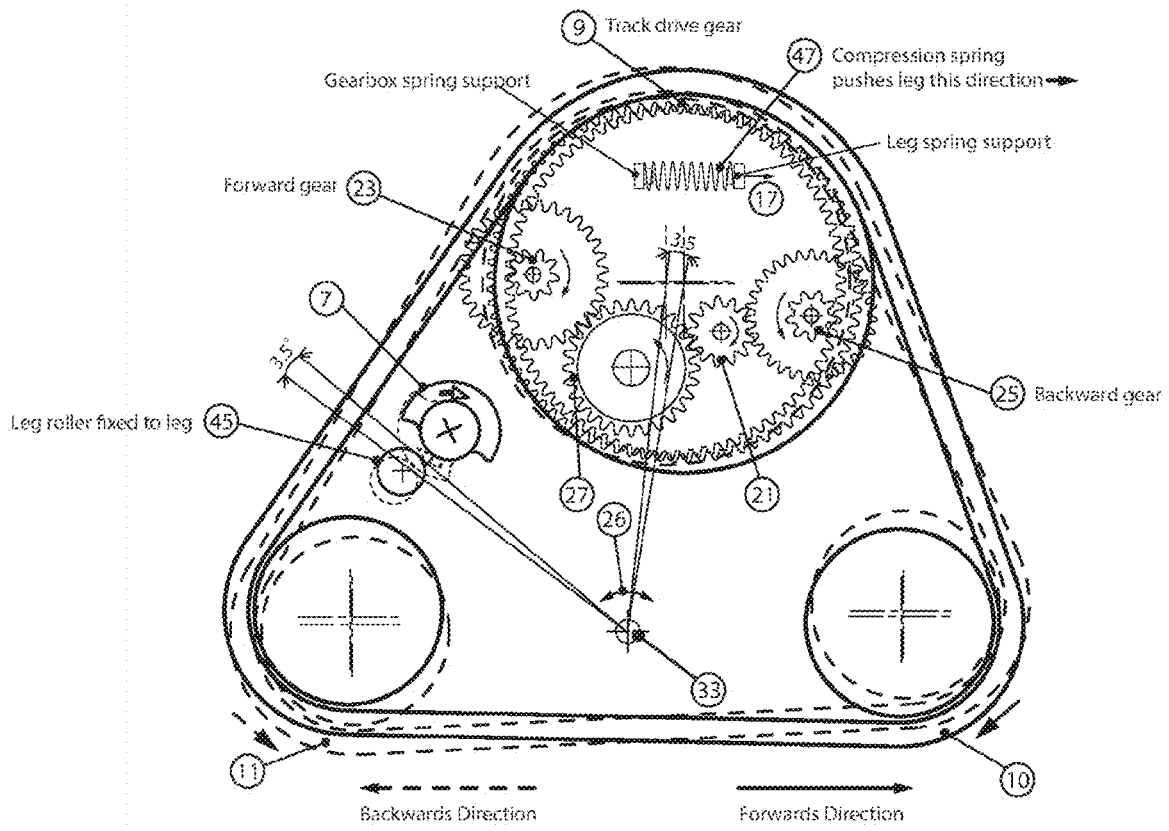
FIG. 8 is a side view of the first (right hand) leg assembly and associated gears of the first gearbox.

The centrally located housing is preferably in the form as a turbine assembly (7). The turbine assembly (7) includes a turbine housing (11) and a rotor (9) located therein. The rotor (9) is positioned between a debris inlet (13), provided in a base region of the turbine housing (11) adjacent a floor surface of the pool, and an outlet (15) of the turbine housing (11). In operation, the turbine (9) is rotated about a horizontal axis by a flow of fluid moving through the turbine housing from the inlet (13) to the outlet (15) in the direction shown by the arrow in FIG. 7.

The suction pool cleaner (1) further includes a first (right hand side) gearbox (17) for driving the first leg assembly (3), and a second (left hand side) gearbox (19) for driving the second leg assembly (5). In this regard, the first and second gearboxes (17, 19) are rigidly attached to the turbine assembly (7) with drive to the gearboxes (17, 19) being provided by a rotatable turbine gear (21), which projects from opposing sides of the rotor (9). The rotatable turbine gear (21) has a toothed profile which rotates with the rotor (9).

Each gearbox (17, 19) includes a forwards gear (23) and a backwards gear (25) which are both operatively driven by the turbine gear (21). Each gearbox further includes a direction reversing gear (27) which is rotated by the turbine gear (21) and in turn drives rotation of the backwards gear (25) in the opposite direction to the forwards gear (23). The forwards gear (23) functions to drive the corresponding leg assembly (3, 5) in a first (forwards) direction, and the backwards gear (25) functions to drive the corresponding leg assembly (3,5) in an opposite second (backwards) direction.

Each gearbox (17, 19) further includes a rotating cam (29) which is indirectly driven by the turbine gear (21) via a series of reduction train gears (31) illustrated in FIGS. 4, 5 and 6. During operation of the suction pool cleaner (1), the average turbine rotor (9) rotational speed is 300 rpm and this is reduced by the reduction train gears (31) such that the cam (29) rotates at a rotational speed of about 0.75 rpm.

Each leg assembly (3, 5) is pivotally mounted with respect to the housing. More specifically, each leg assembly (3, 5) is pivotally mounted with respect to the turbine housing (11), as illustrated in FIGS. 5 and 6. In this regard, the turbine housing (11) includes a housing shaft (33) which projects from either side of the centrally located turbine housing (11). An end of the housing shaft (33) engages with a socket (35) provided in a main body (37) of each leg assembly (3, 5). Each leg assembly (3, 5) is able to pivot about the housing shaft (33) by approximately 3.5°.

Each leg assembly (3, 5) further includes a rotatable loop track (39) which is preferably made of a flexible (elastomeric) material. Each leg assembly (3, 5) further includes a track driving gear (41) which is selectively driven in a clockwise and anti-clockwise direction by the forwards gear (23) and the backwards gear (25). Each leg assembly (3, 5) further includes two brush wheels (43) at a lower forward and rear corner of each leg assembly (3, 5). The rotatable loop track (39) is stretched over the track driving gear (41) and two brush wheels (43) such that rotation of the track driving gear (41) is transmitted to the brush wheels (43) such that the brush wheels (43) and rotatable loop track (39) propel the pool cleaner (1) in a forwards and reverse direction by engaging with the pool surface. Each leg assembly (3, 5) further includes a cam follower which is preferably in the form of a roller (45) which is mounted to the main body (37) for rotational movement.

The suction pool cleaner (1) further includes a compression spring (47) mounted between each gearbox (17, 19) and corresponding main body (37) of the associated leg assembly (3, 5). The compression spring (47) functions to bias each leg assembly (3, 5) towards a first position in which the forwards gear (23) is engaged with the track driving gear (41). When the forwards gear (23) of both leg assemblies (3, 5) is in engagement with the track driving gears (41), the tracks (39) of both leg assemblies (3, 5) are rotated in the first (forwards) direction. The second (left hand side) leg assembly (5) is a mirror image of the first (right hand side) leg assembly (3). When both leg assemblies (3, 5) are driven in forwards and backwards direction, the suction pool cleaner (1) travels at approximately 4.5 mm per second.

Figure 9:
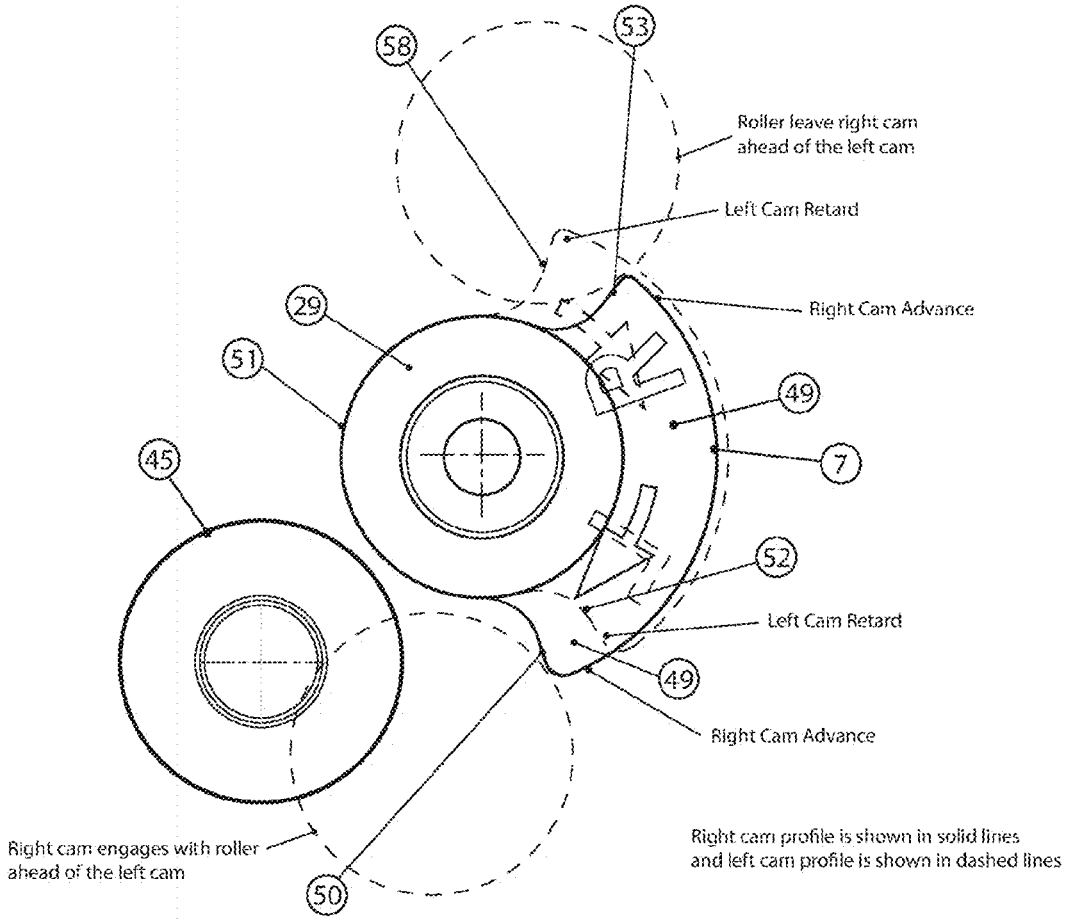
FIG. 9 is an illustration of the cam of the first gearbox and cam of the second gearbox overlapped to illustrate the advancement of the cam of the first gearbox over the cam of the second gearbox relative to the cam follower.

In order to drive the leg assemblies (3, 5) in the opposite second (backwards) direction, the backwards gear (25) of both leg assemblies (3, 5) must instead be engaged with the track driving gear (41). In this regard, the backwards gear (25) rotates in the opposite direction to the forwards gear (23) by virtue of the direction reversing gear (27). In order to move the backwards gear (25) into engagement with the track driving gear (41), the cam (29) is provided with a hill portion (49) and a valley portion (51), as illustrated in FIG. 9. The hill portion (49) covers approximately 30 to 50% of the circumference of the cam (29), preferably approximately 50%. The cam (29) abuts with the roller (45) on the main body (37) of the leg assembly (3, 5) with the transition to the raised hill portion (49) pushing the roller (45) to pivot the leg assembly (3, 5) to the second position in which the backwards gear (25) is engaged with the track driving gear (41). More specifically, the transitioning of the cam (29) from the valley portion (51) to the hill portion (49) pushes the leg assembly (3, 5) against the bias provided by the compression spring (47) such that the leg assembly (3,5) is moved from the first position to the second position in which the backwards gear (25) is engaged.

The shape of the cam (29) is illustrated in FIG. 9. The cam (29) of the first (right hand side) gearbox (17) is advanced ahead of the cam (29) of the second (left hand side) gearbox (19) such that a leading edge (50) of the hill portion (49) of the right hand cam (29) engages with the roller (45) before the leading edge (52) of the hill portion (49) of the left hand cam (29) engages with its corresponding roller (45). In this regard, the cam (29) of the right hand gearbox (17) is advanced by about 12 to 20°, preferably about 16° in comparison to the cam (29) of the left hand gearbox (19). As a result, the track (39) of the first (right hand) leg assembly (3) travels backwards for a short period of time before the track (39) of the left hand side leg assembly (5) transitions to backwards travel. When the tracks (39) are briefly rotating in opposition directions, with the right track (39) moving backwards and the left track moving forwards (39), the pool cleaner (1) will rotate from 15 to 45° in a clockwise direction.

Figure 10:
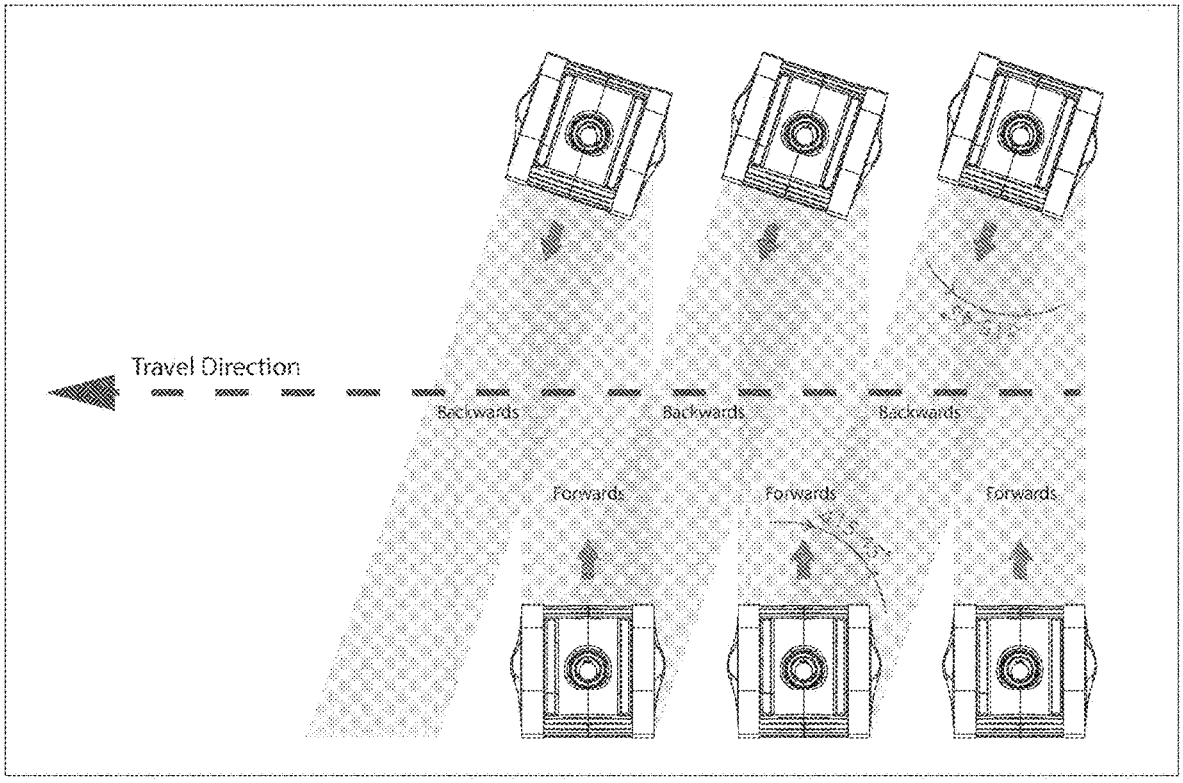
FIG. 10 is an illustration of the zig-zag pattern created by the tracked suction cleaner in accordance with an embodiment of the invention.

Once both tracks (39) are moving backwards, the pool cleaner (1) will travel approximately three meters in a straight line, as illustrated in FIG. 10. After travelling approximately three meters, the hill portion (49) of the right hand cam (29) begins to leave the roller (45) and return again to the valley portion (51). In this regard, a trailing edge (53) of the hill portion (49) of the right hand cam (29) returns the first (right hand side) leg assembly (3) to the first position before the trailing edge (58) of the hill portion (49) of the left hand cam (29) returns the second (left hand side) leg assembly (5) to the first position. In this regard, the trailing edge (58) of the left hand side cam (29) is preferably trails by 17 to 25 degrees, preferably about 21 degrees, in comparison to the trailing edge (53) of the right hand side cam (29).

When the track (39) of the right leg assembly (3) is travelling forwards while the track (39) of the left hand leg assembly (5) is still briefly moving backwards, the pool cleaner (1) will rotate from 15 to 45 degrees anti-clockwise. Once both tracks are moving in the same direction, the cleaner (1) will travel approximately three meters forward in a straight direction before repeating the travel cycle. In order to take into account backlash in cams gearing chain the timing angle from hill portion (49) to valley portion (51) is greater by 5 degrees than the timing angle from valley portion (51) to hill portion (49).

By travelling backwards and forwards whilst rotating the pool cleaner (1) clockwise and anti-clockwise in each direction, the pool cleaner (1) is advantageously able to undertake a cleaning path in a zig zag pattern as illustrated in FIG. 10. In order to make the direction switching as smooth and gentle as possible, the compression spring (47) is preferably selected to be relatively weak (10 newtons) and a relatively soft roller (45) is also utilised. The relatively weak compression spring (47) and roller (45) also advantageously protects the gears of the gearbox (17, 19) from excess forces and acts as a safety clutch.

In an alternative embodiment, the left and right cams (29) can be driven by one gear chain from the turbine assembly (7). The speed, cam profiles as well as timing mentioned above have been given as an example only to explain the principles of the operation. They can easily be altered to make the travel speed, distance and rotation different to suit specific pool conditions.

Figure 11:
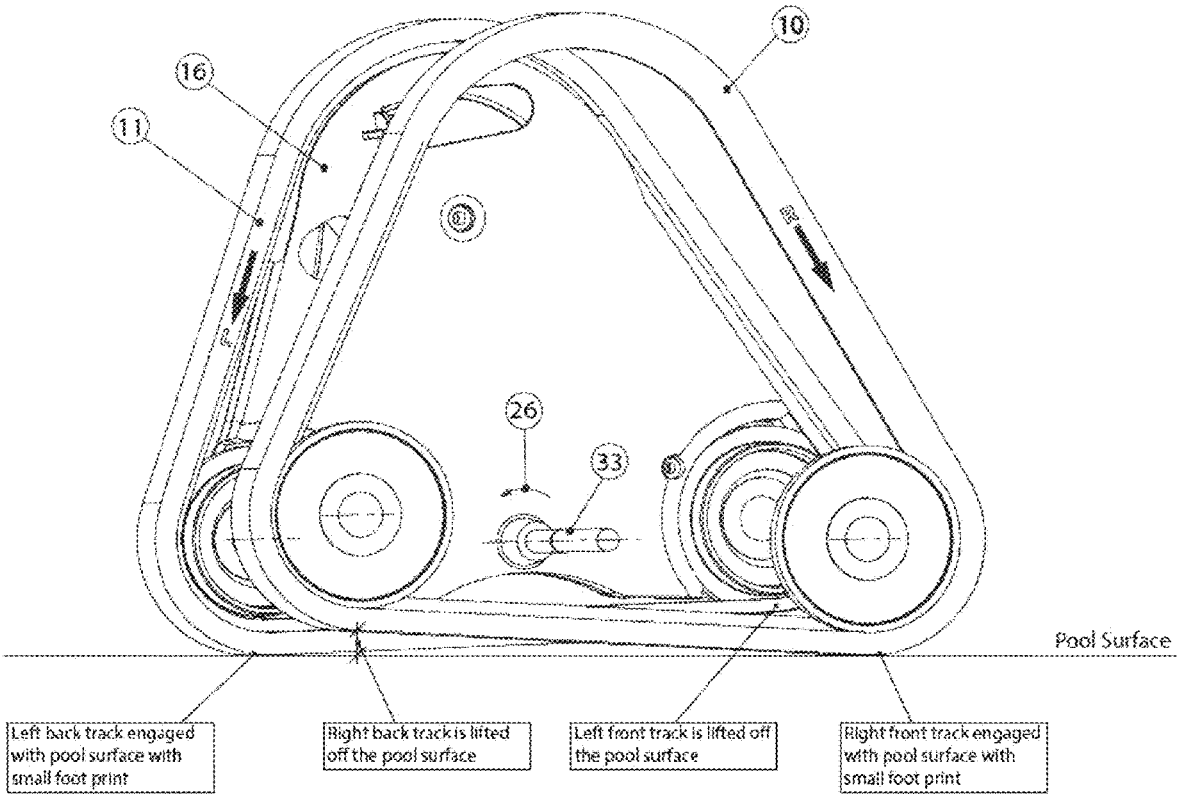
FIG. 11 is a side view of the leg assemblies illustrating the pivotal movement of the first (right hand) leg assembly relative to the second (left hand) leg assembly and the reduced footprint and lift provided.

As mentioned above in the background section, there are frictional forces which must be overcome in order to make a pool cleaner turn about its vertical axis. To reduce the frictional forces, the pivoting of the first and second leg assembly (3, 5) about the housing shaft (33) when switching the travel direction, advantageously lifts diagonally opposite ends of the cleaner (1) from the pool surface, as illustrated in FIG. 11. For example, the right back track (39) is lifted off the pool surface with the front right track remaining in contact with the pool surface thereby providing a reduced overall foot print. Similarly, the left back track is engaged with the pool surface while the left front track is lifted off the pool surface. By lifting the cleaner (1) in this manner during rotation of the pool cleaner (1) the suction force between the inlet (13) and the surface of the pool is reduced. Furthermore, the reduced footprint during this pivotal movement means that less power is required to turn the pool cleaner (1).

What is claimed is:

1. A suction pool cleaner for cleaning of a pool surface, the pool cleaner comprising:

a housing having a debris inlet for suction drawn flow of water and debris;

a first leg assembly positioned at a first lateral side of the housing; and a second leg assembly positioned at a second lateral side of the housing, opposite the first lateral side;

wherein each leg assembly is pivotable with respect to the housing, each leg assembly having a rotatable loop track for moving the pool cleaner over the pool surface, a region of each track in contact with the pool surface defining a footprint, and wherein the tracks are independently and selectively rotatable in a first direction and an opposite second direction, wherein the track of the first leg assembly is configured to rotate in an opposite direction to the track of the second leg assembly to enable the pool cleaner to turn on the pool surface, the opposite rotation of the tracks enabling the leg assemblies to pivot with respect to the housing in opposite directions, causing diagonally opposite ends of the leg assemblies to be lifted from contact with the pool surface, thereby reducing the footprint provided by each track such that less power is required to turn the pool cleaner.

2. The suction pool cleaner as claimed in claim 1 further including a rotor driven by water flow through the pool cleaner, a first gearbox for driving the first leg assembly and a second gearbox for driving the second leg assembly, each gearbox being driven by rotation of the rotor.

3. The suction pool cleaner as claimed in claim 2, wherein each gearbox includes a forward gear for driving the corresponding leg assembly in said first direction and a backward gear for driving the corresponding leg assembly in said opposite second direction.

4. The suction pool cleaner as claimed in claim 3 wherein each leg assembly includes a track drive gear for driving the loop track in said first and second directions, and wherein the leg assemblies are each pivotable with respect to the housing between a first position in which the track drive gear is engaged with the forward gear, and a second position in which the track drive gear is engaged with the backward gear.

5. The suction pool cleaner as claimed in claim 4 wherein each gearbox further includes a cam for moving the corresponding leg assembly between the first position and the second position, the cam being driven by rotation of the rotor, the cam having a valley portion and a hill portion, wherein transitioning from the valley portion to the hill portion pushes the leg assembly from the first position to the second position.

6. The suction pool cleaner as claimed in claim 5 wherein each leg assembly further includes a cam follower mounted to a respective main body of each leg assembly, the cam follower being in abutment with the corresponding gearbox cam to move the leg assembly between the first position and the second position.

7. The suction pool cleaner as claimed in claim 6 wherein the hill portion is provided on about 30% to 50% of a circumference of each cam.

8. The suction pool cleaner as claimed in claim 7 wherein the cam of the first gearbox is advanced in comparison with the cam of the second gearbox such that a leading edge of the hill portion of the cam of the first gearbox pivots the first leg assembly to the second position before a leading edge of the hill portion of the cam of the second gearbox pivots the second leg assembly to the second position.

9. The suction pool cleaner as claimed in claim 8 wherein the cam of the first gearbox is advanced by about 12° to 20° in comparison to the cam of the second gearbox.

10. The suction pool cleaner as claimed in claim 9 wherein a trailing edge of the hill portion of the cam of the first gearbox returns the first leg assembly to the first position before a trailing edge of the hill portion of the cam of the second gearbox returns the second leg assembly to the first position.

11. The suction pool cleaner as claimed in claim 10 wherein the trailing edge of the cam of the second gearbox is retarded by about 17° to 25° in comparison to the trailing edge of the cam of the first gearbox.

12. The suction pool cleaner as claimed in claim 2 wherein each leg assembly is biased towards the first position by a spring mounted between the main body of the leg assembly and corresponding gearbox.

13. The suction pool cleaner as claimed in claim 4 wherein each leg assembly pivots approximately 3.5° when moving between the first position and the second position.

14. The suction pool cleaner as claimed in claim 1, wherein, when the tracks are rotated in opposite directions to one another, the leg assemblies pivot with respect to the housing in opposite directions, thereby lifting the debris inlet away from the pool surface such that suction force between the debris inlet and the pool surface is reduced.

15. The suction pool cleaner as claimed in claim 1, wherein the second leg assembly is arranged as a mirror image of the first leg assembly.

16. The suction pool cleaner as claimed in claim 2, wherein the second leg assembly and second gearbox are arranged as a mirror image of the first leg assembly and first gearbox.

17. The suction pool cleaner as claimed in claim 10, wherein the track of the first leg assembly is configured to transition from rotation in the first direction to opposite rotation in the second direction, whilst the track of the second leg assembly is configured to maintain rotation in the first direction, thereby rotating the pool cleaner.

18. The suction pool cleaner as claimed in claim 17, wherein the track of the first leg assembly and the track of the second leg assembly are configured to rotate in opposite directions for a period of time sufficient to rotate the pool cleaner through an angle of 15° to 45°.

19. A method of operating a suction pool cleaner, the method comprising:

engaging a suction pool cleaner with a pool surface, the pool cleaner comprising:

a housing having a debris inlet for suction-drawn flow of water and debris;

a first leg assembly positioned at a first lateral side of the housing, the first leg assembly comprising a first rotatable loop track which contacts the pool surface, a first track drive gear, and a first cam follower;

a second leg assembly positioned at a second lateral side of the housing, opposite the first lateral side, the second leg assembly comprising a second rotatable loop track which contacts the pool surface, a second track drive gear, and a second cam follower;

a rotor, driven by water flow through the pool cleaner;

a first gearbox configured to drive the first leg assembly, the first gearbox configured to be driven by rotation of the rotor, wherein the first gearbox comprises a first forward gear for driving the first leg assembly in a first direction, a first backward gear for driving the first leg assembly in a second direction opposite to the first direction, and a first cam for moving the first leg assembly between a first position and a second position, the first cam comprising a valley portion and a hill portion and configured to abut the first cam follower of the first leg assembly;

a second gearbox configured to drive the second leg assembly, the second gearbox configured to be driven by rotation of the rotor, wherein the second gearbox comprises a second forward gear for driving the second leg assembly in the first direction and a second backward gear for driving the second leg assembly in the second direction, and a second cam for moving the second leg assembly between a first position and a second position, the second cam comprising a valley portion and a hill portion and configured to abut the second cam follower of the second leg assembly;

wherein the first cam of the first gearbox is in an advanced position in comparison to the second cam of the second gearbox;

engaging the first track drive gear of the first leg assembly and the second track drive gear of the second leg assembly with their respective first and second forward gears, causing rotation of both the first rotatable loop track and the second rotatable loop track in the first direction;

moving the first leg assembly from the first position to the second position, via an interaction of the first cam and the first cam follower, thereby moving the first track drive gear out of engagement with the first forward gear and into engagement with the first backward gear, causing rotation of the first rotatable loop track in the second direction;

rotating the suction pool cleaner through a clockwise angle of 15° to 45°, via rotation of the first rotatable track in the second direction and simultaneous rotation of the second rotatable track in the first direction;

moving the second leg assembly from the first position to the second position, via the interaction of the second cam and the second cam follower, thereby moving the second track drive gear out of engagement with the second forward gear and into engagement with the second backward gear, causing rotation of the second rotatable loop track in the second direction;

rotating both the first rotatable loop track and the second rotatable loop track in the second direction;

returning the first leg assembly from the second position to the first position, via interaction of the first cam and the first cam follower, thereby moving the first track drive gear out of engagement with the first backward gear and into engagement with the first forward gear, causing rotation of the first rotatable loop track in the first direction;

rotating the suction pool cleaner through an anticlockwise angle of 15° to 45°, via rotation of the first rotatable track in the first direction and simultaneous rotation of the second rotatable track in the second direction;

returning the second leg assembly from the second position to the first position, via interaction of the second cam and the second cam follower, thereby moving the second track drive gear out of engagement with the second backward gear and into engagement with the second forward gear, causing rotation of the second rotatable loop track in the first direction.

* * * * *